US006416367B1

(12) United States Patent
Goebel

(10) Patent No.: US 6,416,367 B1
(45) Date of Patent: Jul. 9, 2002

(54) SHIFT LINKAGE

(75) Inventor: Douglas M. Goebel, Mukwonago, WI (US)

(73) Assignee: Bombardier Motor Corporation of America, Grant, FL (US)

( * ) Notice: Subject to any disclaimer, the term of this patent is extended or adjusted under 35 U.S.C. 154(b) by 0 days.

(21) Appl. No.: 09/681,021

(22) Filed: Nov. 28, 2000

(51) Int. Cl.[7] ..... B63H 20/20
(52) U.S. Cl. ..... 440/1; 440/75; 440/86
(58) Field of Search ..... 440/1, 75, 86; 477/101–103, 104–106

(56) References Cited

U.S. PATENT DOCUMENTS 4,432,734 A * 2/1984 Bland et al. ..... 440/1
4,525,149 A * 6/1985 Broughton et al. ..... 440/1
4,838,822 A * 6/1989 Friedle et al. ..... 440/86
5,700,168 A * 12/1997 Mondek et al. ..... 440/1

* cited by examiner

*Primary Examiner*—Sherman Basinger
(74) *Attorney, Agent, or Firm*—Timothy J. Ziolkowski; Cook & Franke SC

(57) ABSTRACT

A shift linkage has a linkage bracket that transmits motion from a drive linkage to a driven linkage. The linkage bracket has a slot that operably engages with a guide to facilitate during an outboard marine engine operation. The slot has an upper and a lower portion such that the lower portion is configured with a lost-motion channel. A guide is disposed in the slot and is configured to ride along the lost motion channel. The drive linkage is connected to the guide to displace initial motion and the driven linkage is connected to the tongue to receive linear motion from the drive linkage. The drive linkage is connected to the guide such that the lost motion channel and the guide are engaged to produce a force having vertical and horizontal components. The vertical component engages a switch and the horizontal component transmits motion to the driven linkage.

17 Claims, 4 Drawing Sheets

SHIFT LINKAGE

BACKGROUND OF INVENTION

The present invention relates generally to shift linkage for an outboard motor, and more particularly, to a linkage assembly having a slot operably engaged with a guide to facilitate the shifting of gears during operation of the outboard motor.

Manual shift vehicles typically employ a clutch to facilitate shifting for engagement and disengagement of the gears in a standard shift transmission. However, in certain types of engine applications, such as marine outboard engines, there is no clutch system and gear shifting can occasionally demand more effort from an operator to shift from a positive gear position to a neutral position.

A typical outboard marine engine has three gearshift positions to provide operation, namely, forward, neutral, and reverse. When attempting to perform a gear shift from forward to neutral, or reverse to neutral, additional effort can be required for a number of reasons. For example, higher than normal engine speed can add pressure tending to keep the gears engaged which requires additional effort to perform a gear shift from a position where the gears are thus engaged to the neutral position where the gears are, of course, disengaged. A binding linkage can also hinder a gear shift. Further, a new gearset can add to binding until the gears are broken in. Further yet, although any one of the aforementioned criteria may not create a binding gear shift alone, a combination of these factors may create additional undesired effort in shifting from a gear position to neutral.

It is therefore desirable to improve the linkage mechanism of the marine outboard engine to overcome the aforementioned problems.

SUMMARY OF INVENTION

The present invention relates to a shift linkage having a linkage bracket to transmit motion from a drive linkage to a driven linkage that solves the aforementioned problems in an outboard motor. The linkage bracket has a slot that operably engages with a guide to facilitate gearshift from forward or reverse to neutral position during operation of an outboard marine engine. The arrangement provides for a lost motion effect in which initial movement of the drive linkage is translated to substantially vertical motion of the guide in the linkage bracket to activate a switch, and then further movement of the drive linkage is then translated to the driven linkage. The result of the lost motion in the direction parallel with the drive and driven linkage provides free play to the linkage to reduce gearshift binding.

Accordingly, the present invention includes a shift linkage having a linkage bracket, a drive linkage and a driven linkage. The linkage bracket has an upper portion and a lower portion, wherein the lower portion is offset from the upper portion. The upper portion also has a pivot point and a tongue extending downwardly from the pivot point and in a common plane with the pivot point and the upper portion. The lower portion has a slot parallel to the tongue and leading to a lost motion channel in the lower end of the slot. An upper end of the lost motion channel is wider than the slot leading to the lost motion channel thereby forming a pair of guide stops in the offset lower portion of the linkage bracket to limit the amount of vertical movement. A guide is disposed in the slot and is configured to ride along the lost motion channel. The drive linkage is connected to the tongue and the driven linkage is connected to the guide to receive linear motion from the drive linkage after an initial movement is translated to create a lost motion that enhances the transfer of the motion through the shift linkage and thus reduce the binding effect.

In accordance with another aspect of the invention, a shift linkage is disclosed for use in an outboard motor having an engine coupled to a marine propulsion unit having forward and reverse operation. The outboard motor includes the aforementioned shift linkage, and further includes a switch positioned about the slot of the linkage bracket and connected to an ECU of the outboard motor. A driven linkage is coupled to the marine propulsion unit at one end and to the guide of the linkage bracket at another end. Initial movement of the drive linkage is translated to substantially vertical motion of the guide in the linkage bracket to activate the switch, after which, further movement of the drive linkage is then translated to the driven linkage.

In accordance with yet another aspect of the invention, a method of transmitting linear motion from a drive linkage to a driven linkage through a linkage bracket to ease shifting of an outboard motor is disclosed. The method includes the steps of applying a linear force to a drive linkage, and during a first phase of shifting, the linear force causes a lost motion in a direction parallel to the linear force and creating a motion in a transverse direction to the linear force through a linkage bracket. During a second phase of shifting, the linear force causes the linkage bracket to pivot and significantly move the driven linkage in the direction parallel to the linear force.

Various other features, objects and advantages of the present invention will be made apparent from the following detailed description and the drawings.

BRIEF DESCRIPTION OF DRAWINGS

The drawings illustrate a presently contemplated embodiment for carrying out the invention.

In the drawings.

DETAILED DESCRIPTION

Figure 1:
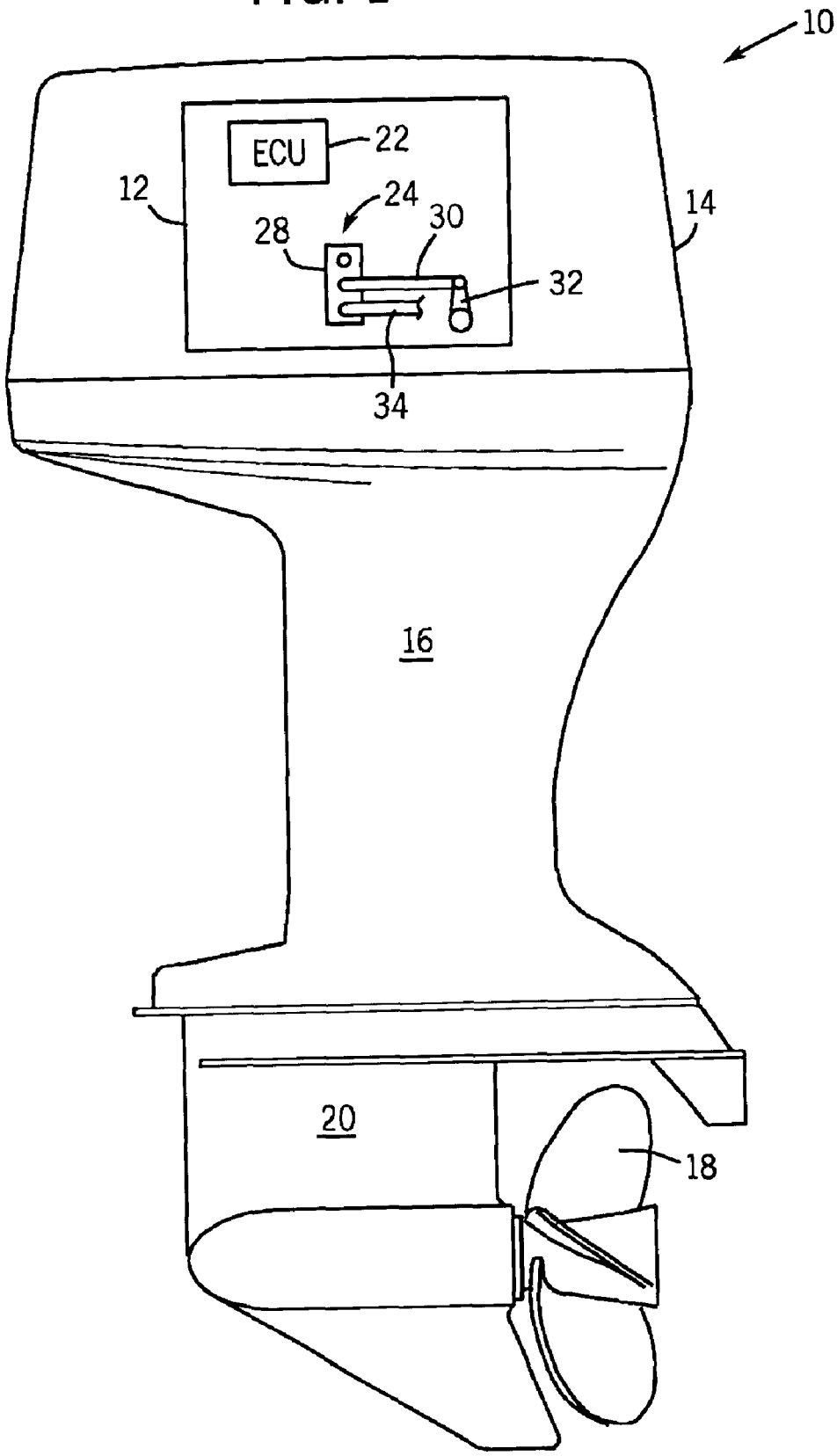
FIG. 1 is a schematic view of an outboard marine engine employing a shift linkage constructed in accordance with one embodiment of the present invention.

Referring to FIG. 1, there is shown a schematic view of an outboard marine engine 10 that includes an internal combustion engine 12 housed in a power head 14 and supported on a mid-section 16 configured for mounting on a transom of a boat (not shown) in a conventional manner. The output shaft (not shown) of the motor 10 is coupled to a propeller 18 extending rearwardly from a lower gear case 20 attached to the lower end of the midsection 16. The internal combustion engine 12 may be controlled by an electronic control unit (ECU) 22, which, in a preferred embodiment, is an integral computer.

The outboard marine engine 10 includes a shift linkage 24 controlled by a shift cable 34. The shift linkage 24 is mounted on a side of the internal combustion engine 12. A linkage bracket 28 is pivotally affixed with respect to the internal combustion engine 12. The shift cable (hereinafter drive linkage) 34 rotates the linkage bracket, and in turn, drives a driven linkage 30 that has one end affixed to the linkage bracket 28 and the other end affixed to a driven arm 32 that is also pivotally affixed with respect to the internal combustion engine 12. The various pivoting motions of the driven linkage 32, the drive linkage 34 and, of course, the linkage bracket 28 will be later explained.

Figure 2:
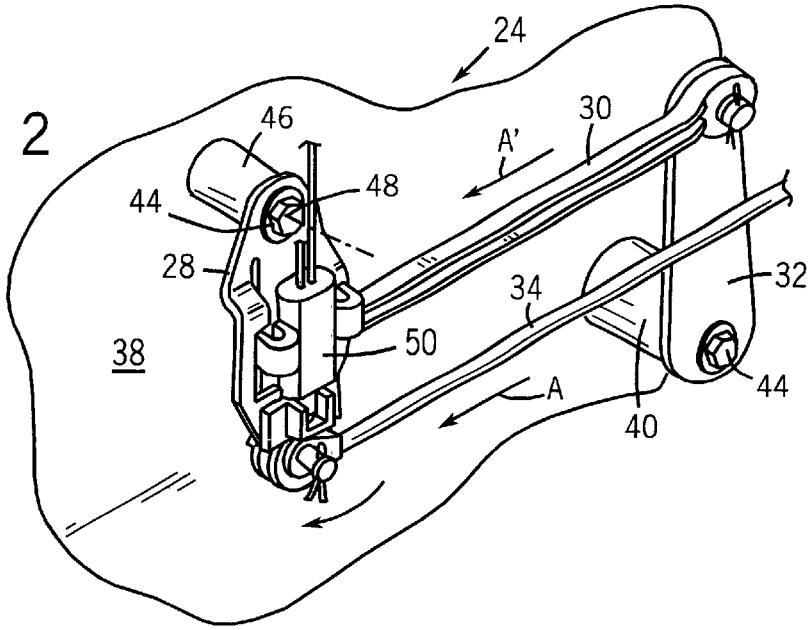
FIG. 2 is an enlarged perspective view of a portion of FIG. 1 that includes the shift linkage constructed in accordance with the present invention.

Turning now to FIG. 2, there is shown, an enlarged perspective view of the shift linkage 24 constructed in accordance with the present invention. In this Figure there can be seen the driven arm 32 is pivotally affixed to a stationary surface 38 with respect to the internal combustion engine 12. The stationary surface 38 may be a surface of the internal combustion engine 12 itself or a fixed surface that is a part of the engine housing or other component fixed in position. As such, the pivotal mounting of the driven arm 32 may be by means of a driven arm spindle 40, and which is, in turn, pivotally affixed to the stationary surface 38 by means such as a bolt 44 or may be welded.

The linkage bracket 28 is also pivotally affixed to the stationary surface 38 and that affixation can be by a similar means including a linkage bracket spindle 46 that is, in turn, affixed to the stationary surface 38 by means of a bolt 44, thereby creating a pivot point 48 for the linkage bracket 28. The driven linkage 30 is affixed to the linkage bracket 28 a finite distance or radial length away from the pivot point 48 and the drive linkage 34 is also affixed to the linkage bracket 28 a further radial length away from that pivot point 48, as will later become clear, it being sufficient at this point to note that the movement of the drive linkage 34 in the direction of arrow A, will cause the linkage bracket 28 to rotate in the clockwise direction and further cause the driven linkage 30 to also move generally in the direction of the arrow A'. That clockwise rotation of the linkage bracket 28 will therefore cause the driven linkage 30 to move in the direction of the arrow A', such that the driven arm 32 can cause the shifting of the gear position of the outboard marine engine between the reverse, neutral and forward positions, in a conventional manner. An electrical switch 50 is also mounted on the linkage bracket 28 in a specially constructed manner as will later be described.

Figure 3:
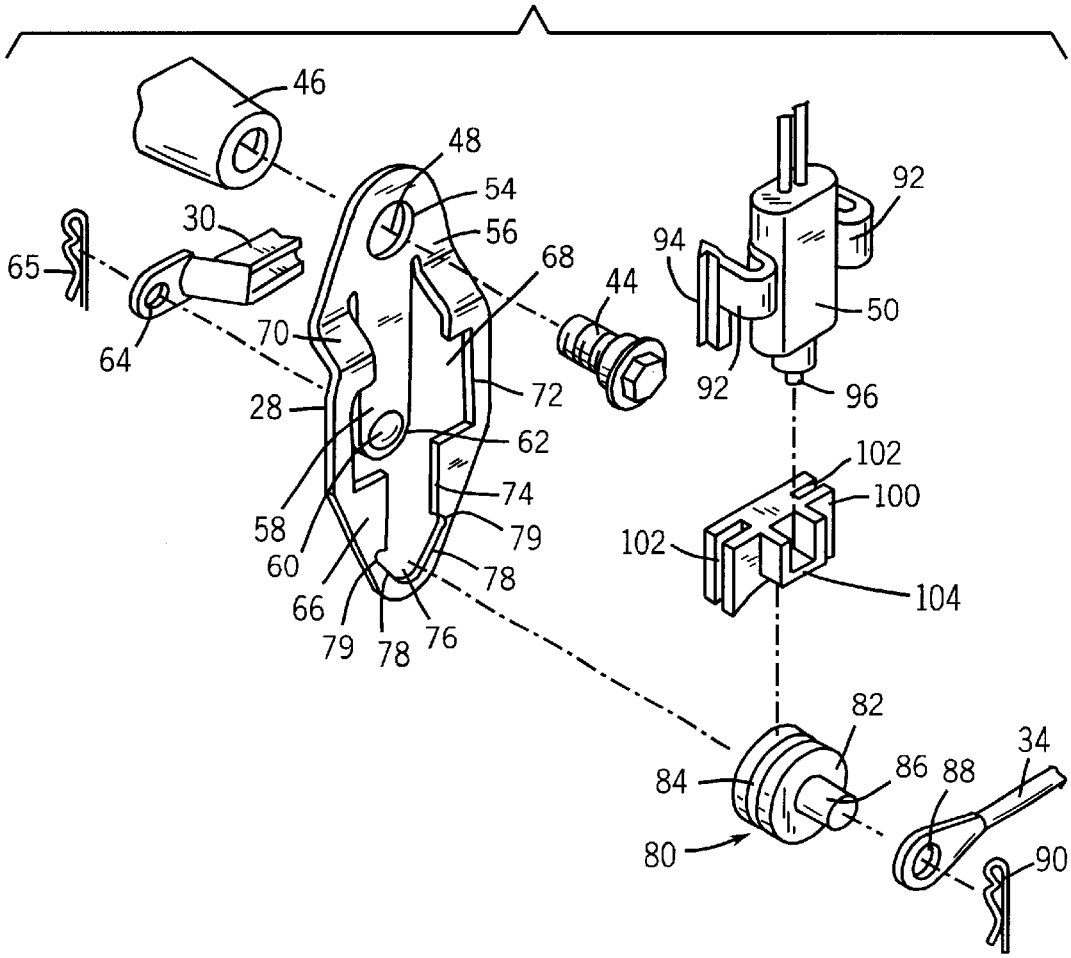
FIG. 3 is an exploded perspective view of a portion of FIG. 2 showing the present invention.

Turning now to FIG. 3, there is shown an exploded perspective view of certain of the components used in construction of the shift linkage 24 of FIG. 2. In FIG. 3 there can be seen the pivot point 48 about which the linkage bracket 28 rotates by means of the affixation with the linkage bracket spindle 46 by bolt 44 passing through an opening 54 formed in the upper portion 56 of the linkage bracket 28. The linkage bracket 28 itself is formed in a special configuration and comprises a downwardly directed tongue 58 from that upper portion 56 and which extends downwardly from the pivot point 48 and is formed so as to be in the same plane as the opening 54 as well as the pivot point 48 and upper portion 56 of the linkage bracket 28. A stub 60 is formed in the lower end 62 of the tongue 58 and allows the driven linkage 30 to be affixed to the linkage bracket 28 by means of the stub 60 passing through a hole 64 at the end of the driven linkage 30 and affixed together by a cotter pin 65.

The linkage bracket 28 also comprises a lower portion 66 extending downwardly from the upper portion 56 and in which is formed a slot 68 of a particular configuration. The lower portion 66 and the slot 68 formed therein are in a plane that is displaced forwardly with respect to the plane of the pivot point 48 and tongue 58 as there is a forwardly extending transition portion 70 intermediate the upper portion 56 and the lower portion 66 of linkage bracket 28. In particular, the slot 68 comprises a wide, upper portion 72, a narrower intermediate portion 74 and a lower tapered portion 76 having a downwardly, inwardly tapered surface 78 in the general configuration of an arrow. At the upper point where the lower, tapered portion 66 intersects with the intermediate portion 74, there is formed an abrupt shoulder forming a guide stop 79.

A guide 80 is fitted for movement within the lower portion 76 of the slot 68 and the guide comprises a roller 82 having an external groove 84 formed in outer peripheral surface of the roller 82 so that the groove 84 rides along the inwardly tapered surface 78 of the lower portion 76 of slot 68. Roller 82 further has an outwardly extending shaft 86 that passes through a hole 88 formed in the end of the drive linkage 34 and can be secured thereto by a cotter pin 90. Thus, guide 80 is basically secured to the drive linkage 34 and guide 80, as well. Therefore, the drive linkage 34 can be moved by the rotational movement of the linkage bracket 28.

The electrical switch 50 includes a pair of spring brackets 92 that extend outwardly from both sides of the electrical switch 50 and each of the spring brackets 92 has an elongated indentation 94 (only one of which is shown) that interfit with the inner edges of the upper portion 72 of the slot 68 such that the spring brackets 92 secure the electrical switch 50 to the lower portion 66 of the linkage bracket 28. A switch button 96 extends downwardly from electrical switch 50 and is axially movable in order to operate the electrical switch 50 i.e. by making and breaking a circuit.

A slide actuator 100 is positioned intermediate the electrical switch 50 and the guide 80 and operates to move the switch button 96 in its axial direction to operate the electrical switch 50. As can be seen, the slide actuator 100 also has a pair of elongated slots 102 formed in each side thereof and the elongated slots 102 interfit with the internal edges of the intermediate portion 74 of the slot 68 so that the slide actuator 100 can freely slide along the internal edges of the slot 68 and move axially to contact and cause the switch button 96 to also move axially and thus operate the electrical switch 50. In order to align and interfit with the switch button 96, there is an extended housing 104 molded into the slide actuator 100 to receive and contain the switch button 96 and thus provide protection to the switch button 96 from inadvertent damage.

Figure 4:
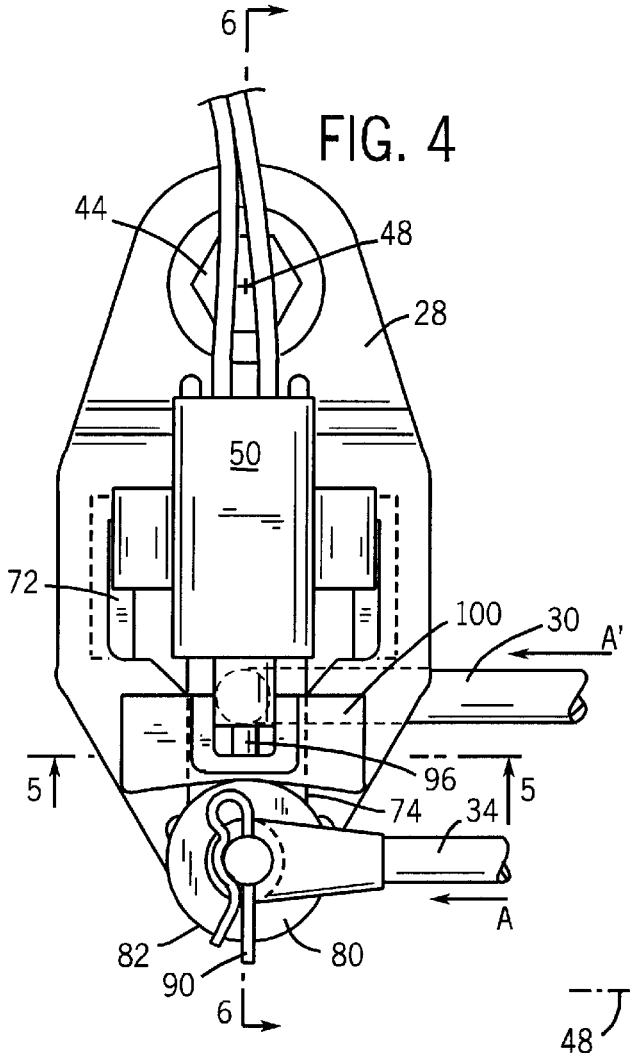
FIG. 4 is a side plan view of a portion of FIG. 2.

Turning now to FIG. 4, there is shown a view of the components of the shift linkage 24 of the present invention in the assembled condition. As can be seen, the linkage bracket 28 is pivotally mounted to a fixed surface which may be the internal combustion engine itself (not shown in FIG. 4) by means of the bolt 44 to constitute a pivot point 48 for the linkage bracket 28. The driven linkage 30 is also affixed to the linkage bracket 28 as is the drive linkage 34, the latter being connected to the linkage bracket 28 at a further distance or moment arm from that pivot point 48. As the drive linkage 34 is moved in the direction of the arrow A, the linkage bracket 28 rotates clockwise about pivot point 48 and moves the driven linkage 30 in the direction of the arrow A'.

In the initial movement of the drive linkage 34 in the direction of the arrow A, however, the guide 80 moves along the internal edge of the inwardly tapered surface 78 of the lower portion 76 of slot 68 and thus the guide 80 moves in a generally vertically upward direction and not immediately in the direction of the arrow A. Thus, as the movement of the drive linkage 34 progresses, the initial movement causes the guide 80 to move in a generally vertical upward direction to cause the slide actuator to also move upwardly to depress the switch button 96 and thus activate the electrical switch 50. Continued movement of the drive linkage 34 thus causes the guide 80 to reach a high corner or guide stop 79 at the upper corner of the tapered surface 78 where the guide 80 cannot continue further in the upward direction and the movement of the drive linkage 34 thereafter causes full movement of the driven linkage 30 in the direction of the arrow A", thus, there is a slight lost motion between the drive linkage 34 and the driven linkage 30.

Figure 5:
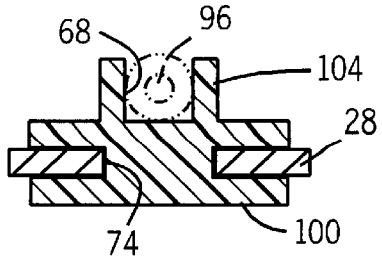
FIG. 5 is a cross-sectional view taken generally along line 5—5 of FIG. 4.

Turning briefly to FIG. 5, there is shown a cross-sectional view taken along the line 5—5 of FIG. 4 and showing the switch button 96 captured within the extended housing 104 of the slide actuator 100 and the interfitting of the slide actuator 100 within the inner edge of the intermediate portion 74 of the slot 68.

Figure 6:
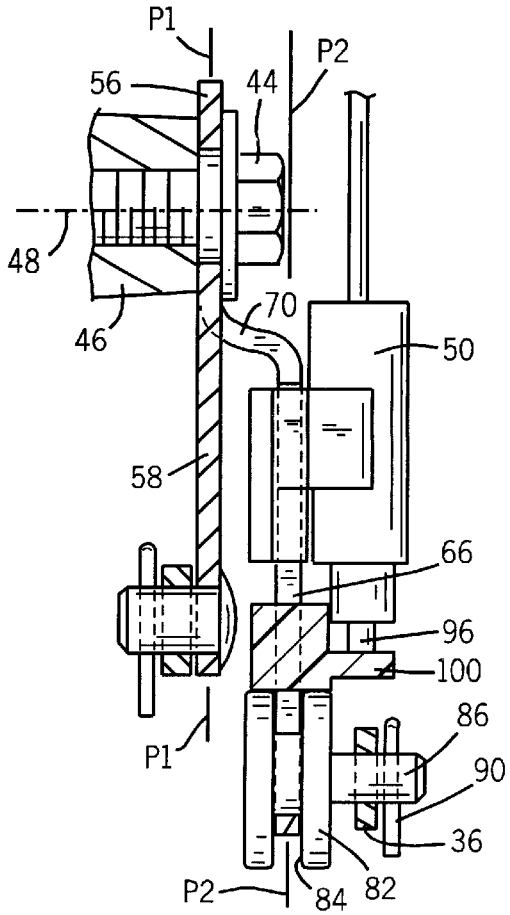
FIG. 6 is a cross-sectional side view taken generally along line 6—6 of FIG. 4 showing a switch in an open position.

Turning next to FIG. 6, there is shown a side cross sectional view taken along the line 6—6 of FIG. 4 and showing, more clearly, the plane P1 of the upper portion 56 of the linkage bracket 28 and the plane P2 of the lower portion 66 and illustrating the displacement of those planes with respect to each other caused by the transition portion 70 of the linkage bracket 28 that is between the upper portion 56 and the lower portion 66. Thus, the tongue 58 and the pivot point 48 are in the same plane P1 and the lower portion 66 of the linkage bracket 28 are in another plane P2.

Figure 7:
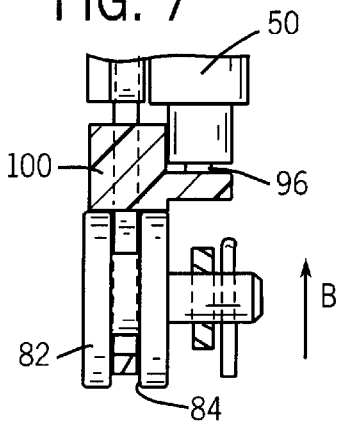
FIG. 7 is a fragmentary sectional view of a portion of FIG. 6 showing the switch in a closed position.

As also can be noted in FIG. 6, the switch button 96 is in its non-depressed or extended position since the guide 80 is at the bottom of the generally V-shaped or arrow shaped lower portion 72 of the slot 68. Turning briefly to FIG. 7, there is shown a fragmented view of a portion of FIG. 6 and showing switch button 96 in its depressed position or upper position where the electrical switch 50 is activated. Thus, in FIG. 7, the guide 80 has moved vertically upwardly as seen by the Arrow B by sliding along the arrow shaped tapered surface 78 (FIG. 4) of the slot 68 and thus the slide actuator 100 has also moved upwardly, as is normal during the initial movement of the drive linkage 34 in the direction of the arrow A of FIG. 4.

Figure 8A:
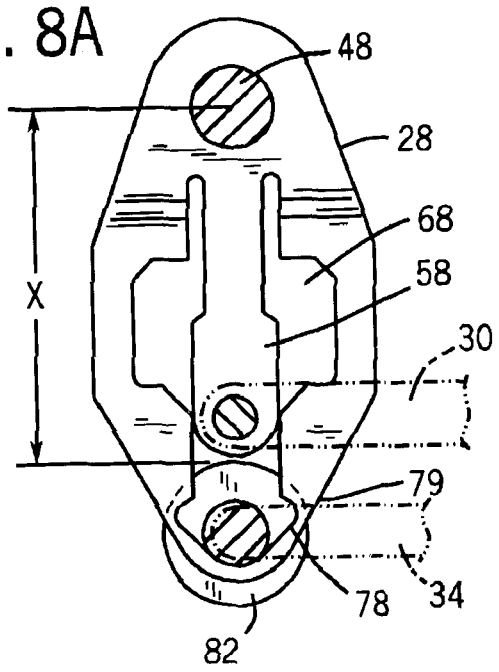
FIG. 8A is a side plan view of a linkage bracket with accordance with the present invention in a rest, neutral position showing a portion of the shift linkage in phantom.
Figure 8B:
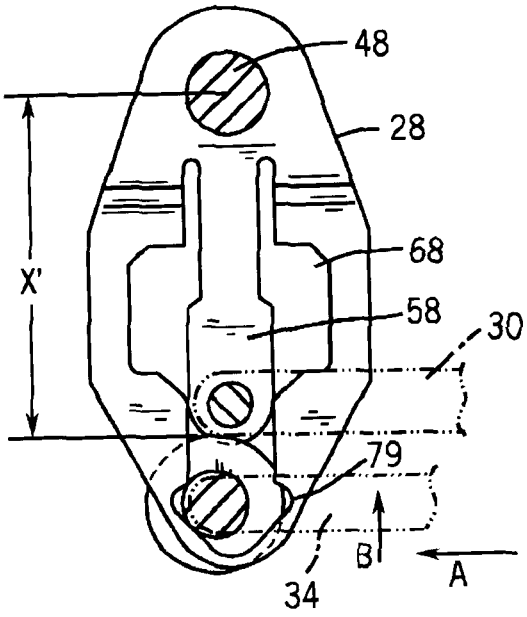
FIG. 8B is a side plan view, similar to FIG. 8A, but showing the linkage in motion during a first phase of shifting.
Figure 8C:
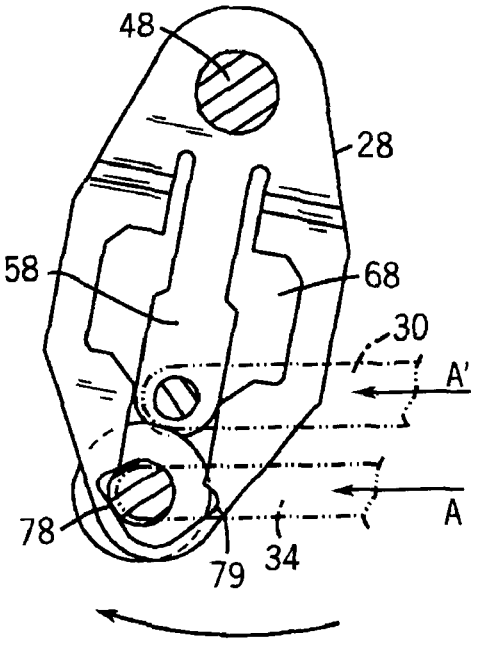
FIG. 8C is a side plan view, similar to FIGS. 8A and 8B, but showing the linkage motion during a second phase of shifting.

FIGS. 8A, 8B, and 8C illustrate the operation of the linkage bracket 28 in three different phases. As can be seen, there is a finite linear distance X from the pivot point 48 to the tip of the guide 80 that varies as the roller 82 moves upwardly and downwardly along the inwardly tapered surface 78. Before the initial movement of the drive linkage 34, the roller 82 is in the lowest position within the lower portion 76 of the slot 68. As the drive linkage 34 moves in the direction of the arrow A, FIG. 8B, it causes the roller 82 to move upwardly along the tapered surface 78 along arrow B without displacing the driven linkage 30. However, it is important to recognize that the displacement ratio between the drive linkage 34 and the driven linkage 30 is one to one (1:1) after the slack, or lost motion, is absorbed by the initial movement. Therefore, in the second phase of movement as shown in FIG. 8B, the roller 82 moves upward until it reaches its highest position on the tapered surface 78 at the guide stop 79 and closes the switch button 96 of the electrical switch 50 (not shown). In a third phase of movement, as shown in FIG. 8C, further displacement of the drive linkage 34 in the direction of the arrow A causes the linkage bracket 28 to further rotate and in turn cause the driven linkage 30 to move in the direction of the arrow A" as shown in FIG. 8C.

Referring again to FIGS. 8A and 8B, it can be seen that the length X is different in FIGS. 8A and 8B because the roller 82 is in a higher position in FIG. 8B to close the button of the switch (not shown in these Figures) and to compensate for the vertical length of the button in close/open position as best viewed in FIGS. 6 and 7.

The present invention has been described in terms of the preferred embodiment, and it is recognized that equivalents, alternatives, and modifications, aside from those expressly stated, are possible and within the scope of the appending claims.

What is claimed is:

1. A shift linkage comprising:

(A) a linkage bracket having an upper portion and a lower portion offset from the upper portion, the upper portion having a pivot point therein and a tongue extending downwardly therefrom in a common plane with the pivot point and the upper portion, the lower portion having a slot parallel to the tongue and leading to a lost-motion channel in a lower end of the slot wherein an upper end of the lost-motion channel is wider than the slot leading to the lost-motion channel thereby forming a pair of guide stops in the offset lower portion of the linkage bracket;

(B) a driven linkage connected to the tongue of the linkage bracket;

(C) a guide disposed in the lost-motion channel and configured to ride along either side of the lost-motion channel until the guide contacts one of the pair of guide stops; and (D) a drive linkage connected to the guide.

2. The shift linkage of claim 1 wherein the lost-motion channel is arrow shaped and extends downward from a bottom of the tongue.

3. The shift linkage of claim 1 further comprising a switch having a pair of laterally-aligned brackets on opposite sides thereof to snap fit into the slot of the linkage bracket.

4. The shift linkage of claim 1 wherein the guide comprises a roller having a translational force displacement that includes a vertical force component and a horizontal force component, wherein the vertical force component causes the roller to move substantially vertically to engage a switch and the horizontal force component causes the roller and linkage bracket to move substantially horizontally to transmit motion to the driven linkage only after the vertical force component has reached a vertical limit.

5. The shift linkage of claim 4 wherein the roller includes a groove and a shaft, wherein the groove is configured to engage with the lower portion of the linkage bracket about the slot and the drive linkage is connected to said shaft.

6. The shift linkage of claim 1 wherein movement of the driven linkage is partially displaced horizontally by vertical movement of the guide in the lost-motion channel of the linkage bracket.

7. The shift linkage of claim 1 incorporated into an outboard motor such that horizontal movement of the drive linkage is partially translated to vertical motion in the linkage bracket to engage a switch and create a given amount of free-play with the driven linkage to permit easier shifting of the outboard motor.

8. An outboard motor comprising:

(A) an engine coupled to a marine propulsion unit having a set of gears for forward and reverse operation;

(B) a linkage bracket having an upper portion and a lower portion offset from the upper portion, the upper portion having a pivot point therein and a tongue extending downwardly therefrom in a common plane with the pivot point and the upper portion, the lower portion having a slot parallel to the tongue and leading to a lost-motion channel in a lower end of the slot wherein an upper end of the lost-motion channel is wider than the slot leading to the lost-motion channel thereby forming a pair of guide stops in the offset lower portion of the linkage bracket, and a guide disposed in the lost-motion channel and configured to ride along either side of the lost-motion channel until the guide contacts one of the pair of guide stops;

(C) a switch positioned about the slot of the linkage bracket and connected to an ECU of the outboard motor which controls operation of the engine; and (D) a drive linkage coupled to a shifting mechanism at one end and to the linkage bracket to drive the linkage bracket to pivot about a pivot axis; and (E) a driven linkage coupled to the marine propulsion unit at one end and to the linkage bracket at another end, wherein initial movement of the drive linkage is translated to substantially vertical motion of the guide in the linkage bracket to activate the switch and further movement of the drive linkage is then translated to the driven linkage.

9. The outboard motor of claim 8 further comprising a slide actuator, wherein the slide actuator and the guide mounted on the linkage bracket engage with one another and transmit motion from the drive linkage to the driven linkage after the switch is activated by the guide and slide actuator.

10. The outboard motor of claim 9 wherein the guide is a roller having a groove and a pin, wherein the groove is configured to engage the linkage bracket in the lost-motion channel and the shaft receives the drive linkage thereon.

11. The outboard motor of claim 8 wherein the lost-motion channel is arrow shaped and extends downward from a bottom of the tongue.

12. The outboard motor of claim 8 wherein the switch has a pair of brackets to clip to the slot in the linkage bracket.

13. The outboard motor of claim 8 wherein the guide comprises a roller having a translational force displacement that includes a vertical force component and a horizontal force component, wherein the vertical force component causes the roller to move substantially vertically to engage the switch and the horizontal force component causes the roller and linkage bracket to move substantially horizontally to transmit motion to the driven linkage only after the vertical force component has reached a vertical limit.

14. A method of transmitting linear motion from a drive linkage to a driven linkage through a linkage bracket to ease shifting of an outboard motor, the method comprising the steps of:

(A) applying a linear force to a drive linkage;

(B) during a first phase of shifting, the linear force causing a lost motion in a direction parallel to the linear force and creating motion in a transverse direction to the linear force through a single lost motion channel in a linkage bracket; and (C) during a second phase of shifting, the linear force causing the linkage bracket to pivot and more the driven linkage in a direction parallel to the linear force.

15. The method of claim 14 further comprising the step of activating a switch disposed in the linkage bracket with the created motion transverse to the linear force at a completion of the first phase of shifting.

16. The method of claim 15 wherein the step of shifting during the second phase includes allowing a switch actuator to move downwardly and deactivate the switch at completion of a shift.

17. A shift linkage comprising:

(A) means for applying a linear force to a drive linkage;

(B) means for shifting during a first phase wherein the linear force causes a lost motion in a direction parallel to the linear force and creates motion a transverse direction to the linear force through a lost motion channel in a linkage bracket that receives the means for applying a linear force therein; and (C) means for shifting during a second phase wherein the linear force causes the linkage bracket to pivot and move a driven linkage in a direction parallel to the linear force.

* * * * *